US006000480A

United States Patent [19]

Eik

[11] Patent Number: 6,000,480

[45] Date of Patent: Dec. 14, 1999

[54] ARRANGEMENT IN CONNECTION WITH DRILLING OF OIL WELLS ESPECIALLY WITH COIL TUBING

[75] Inventor: Geir Eik, Hebekk, Norway

[73] Assignee: Mercur Slimhole Drilling Intervention AS, Norway

[21] Appl. No.: 08/941,944

[22] Filed: Oct. 1, 1997

[51] Int. Cl.[6] ..... E21B 7/128

[52] U.S. Cl. ..... 175/8; 166/350; 405/195.1

[58] Field of Search ..... 166/345, 350, 166/367, 77.2; 405/195.1, 196, 205; 175/8, 7

[56] References Cited

U.S. PATENT DOCUMENTS

| | | | |
|---|---|---|---|
| 3,797,256 | 3/1974 | Giblon | 405/196 |
| 3,804,369 | 4/1974 | Sutton | 405/196 X |
| 4,427,319 | 1/1984 | Mayr | 405/196 |
| 4,437,792 | 3/1984 | Durand et al. | 405/196 X |
| 4,616,707 | 10/1986 | Langner | 166/345 |
| 5,671,811 | 9/1997 | Head | 166/346 |

FOREIGN PATENT DOCUMENTS 131352 2/1975 Norway .

177017 3/1995 Norway .

*Primary Examiner*—Frank Tsay

*Attorney, Agent, or Firm*—Hedman, Gibson & Costigan, P.C.

[57] ABSTRACT

The present invention relates to an arrangement in connection with the drilling of oil wells, especially with coil tubing, and more specifically an arrangement comprising heave compensation by such drilling, comprising a first frame-like structure (3) which in relation to a floating vessel (1A) is mounted for allowing movement at least in the vertical direction in relation to said vessel, as well as devices for providing compensating power between said first frame stucture (3) and said vessel (1A), and in order to provide an improved heave compensation system it is according to the present invention suggested that said arrangement further comprising a second frame-like structure (1) arranged stationary on the deck (1AA) of the vessel (1A), said first compensated frame-like structure (3) and said second frame-like structure (1) being assembled by means of a further system (4) allowing compensation of said relative movement between the vessel (1A) and said compensated structure (3), i.e. heave compensation both in relation to said vessel (1A) and said first frame structure (3).

18 Claims, 10 Drawing Sheets

ARRANGEMENT IN CONNECTION WITH DRILLING OF OIL WELLS ESPECIALLY WITH COIL TUBING

FIELD OF THE INVENTION

The present invention relates to an arrangement in connection with drilling of oil wells, especially with coil tubing, and more specifically and arrangement in which a heave compensation is involved.

The present invention finds particular application in a coil tubing arrangement, and more specifically in such an arrangement designed to be installed on a vessel with a moon pool, wherein operations are to be effected through said moon pool.

PRIOR ART

There are previously known drilling techniques involving coil tubing wherein the coil tubing reel is suspended in the derrick of the vessel, at the same time as the hoisting hook is provided with a compensator. Such an arrangement requires a specific balance of weight between pipe and compensator, which involves that the prior art arrangement is difficult to handle during use.

NO 177 017, bearing the title "Device for preventing that an element which is attached to a mobile installation is influenced by the movement of this installation", discloses a method wherein the drilling pipe can be kept stationary during the drilling. This is a prior art technique for achieveng a passive compensation of the hook which is included in a mobile installation, and the technique is used on most of two-days drilling rigs, but the publication is silent about any inner frame which as a whole is to be kept stationary in relation to the sea bed.

NO 121 352, bearing the title "Method for installing and maintaining a platform at a fixed distance above the sea bed and a floating structure for carrying out the method", devises a solution which is depending on a fixed bottom anchoring in order to function, whereas in accordance to the present invention there is devised a compound arrangement wherein a passive system will balance the weight in question, and wherein an active system is used for compensating the movement.

Neither do the prior art publications give any instructions for such a compound technique which can be used appropriately for compensating any change in tide water.

OBJECTS OF THE INVENTION

A basic object of the present invention is to provide a coil tubing drilling system involving safer and better drilling with coil tubing, as well as with single drilling pipes, especially from floating drilling units.

Another object of the present invention is to provide a coil tubing drilling system and a single pipe drilling system involving effective compensation both during preparatory drilling, during drilling involving single drilling pipes, coil tubing, as well as during exchange of coil tubing reels.

Yet another object of the invention is to provide a complete coil tubing handling system, a drilling pipe handling system and a compensation system which is favorable both as regards material transport as well as personal transport.

Still another object of the invention is to provide a drive compensating device providing the possibility to compensate for increased load by using on the one hand active compensators in such a manner that they, on the other hand, pull against passive cylinders, and as the weight is increasing this pull will be smaller and smaller because the cylinders are controlled on measured displacement (quantity) and not on pressure.

Still another object of the present invention is to solve the problem of access to a first compensated structure and the transfer of loads between the vessel deck and the compensated structure.

Another object of the present invention is to adapt such a compound compensating system to the changes in tide water.

SUMMARY OF THE INVENTION

These objects are achieved in an arrangement of the type as disclosed in the preamble, and which arrangement is defined by the features as stated in the enclosed patent claims.

Further features and advantages of the present invention will appear from the following description taken in connection with the apended drawings, as well as from said enclosed patent claims.

BRIEF DISCLOSURE OF THE DRAWINGS

DETAILED DESCRIPTION OF EMBODIMENTS

General Description

Figure 3:
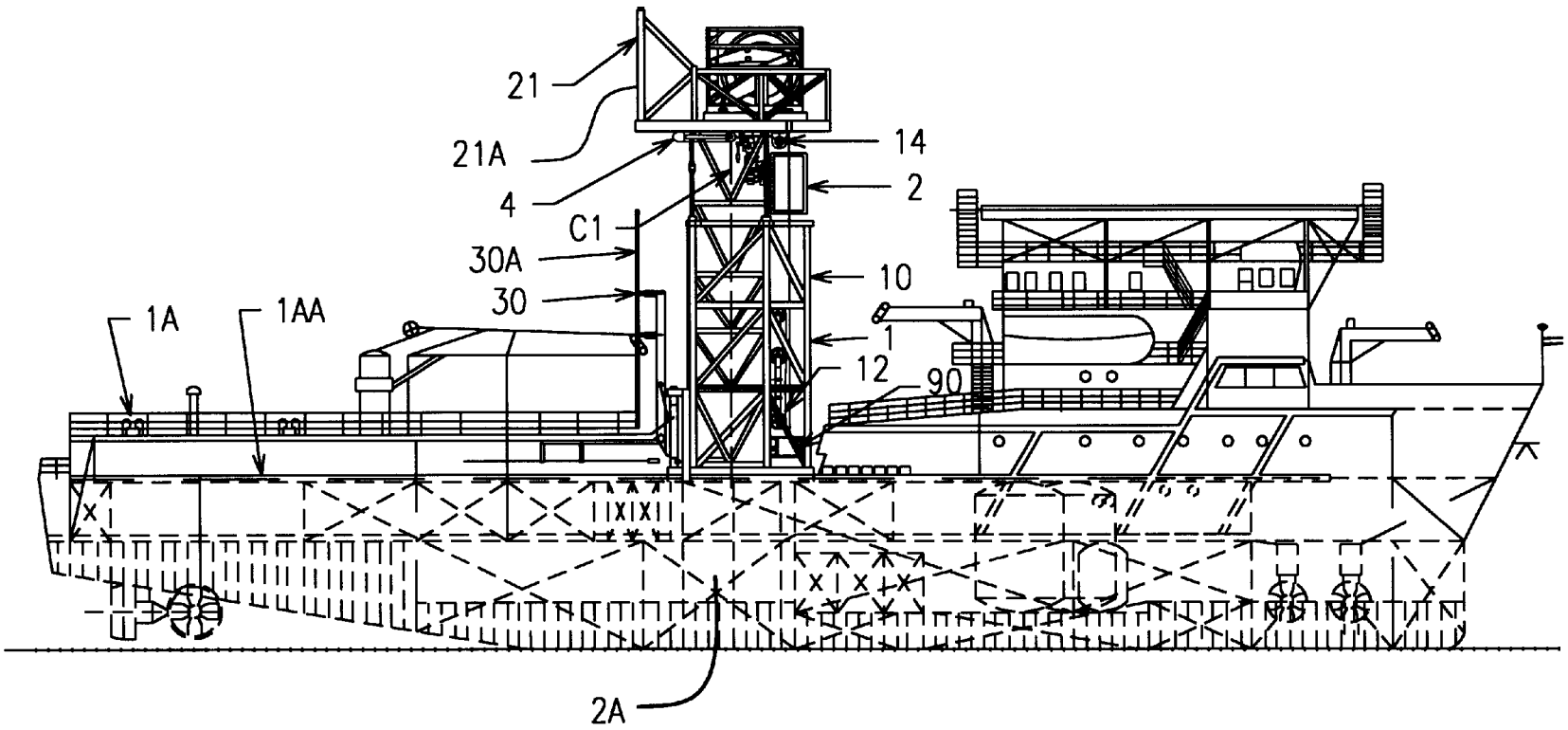
FIG. 3 illustrates a 180° side view of a general layout, related to coil tubing drilling, as well as to snubbing and top drive drilling, and more specifically in relation to a vessel.

The system or the arrangement to which the present invention relates, can generally be designed as different modules which can be installed on a vessel 1A having a deck 1AA and a moon pool 2A wherein the operations are effected through said moon pool 2A, see for example FIG. 3. The different modules are assembled in order to provide a complete coil tubing handling and compensating system.

The coil tubing arrangement comprises a plurality of modules containing the equipment and the machinery required to complete the necessary operations. In addition the modules required to support and compensate the coil tubing reel auxillary modules, which are required for the operation, will be installed on the deck of the vessel. This covers the mud pumping and storage module together with storage and transportation systems for blow-out preventers, and injector head.

The main modules may comprise:

Coil tubing installation 70 and support structures 1 and 3, and preferrably including four common compensators 70A–70D, for balancing the weights.

Access module or a stationary frame-like structure 1 including two compensators 80A and 80B.

Pipe and tublar handlers, 30 and 21, respectively.

Figure 4B:
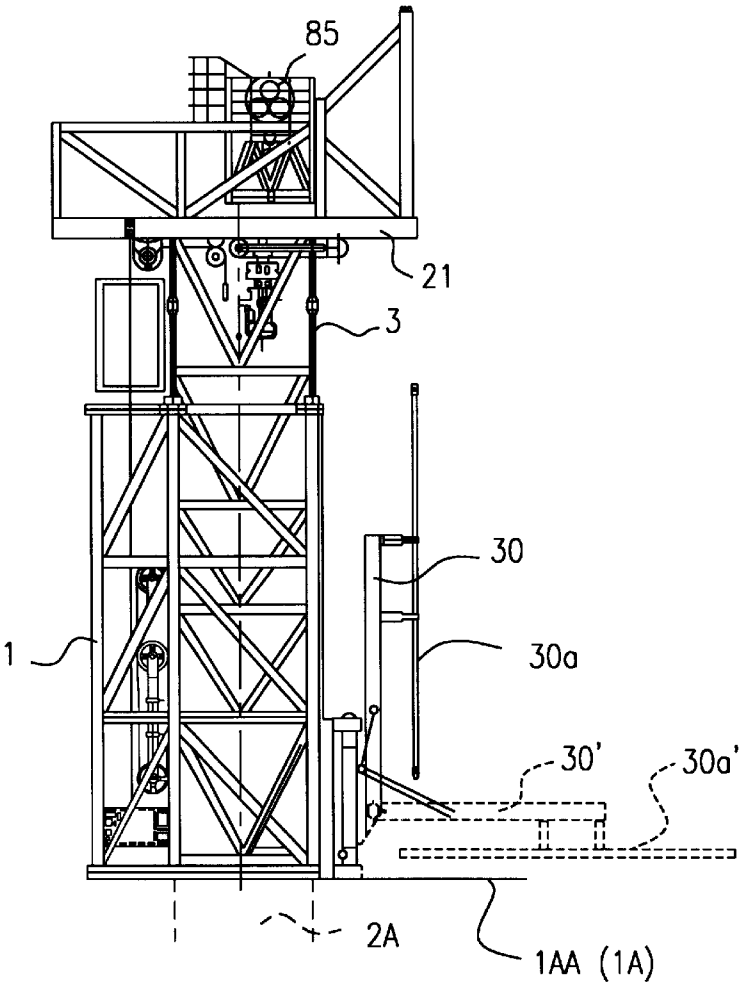
FIGS. 4A and 4B illustrate further details concerning top drive drilling and pipe handling, respectively.

Modified snubbing unit, especially a hoisting unit 85 for drilling with drilling pipe/alternatively light weight hydraulic draw work, see FIG. 4B Mud circulation module (not shown).

Hydraulic power unit (HPU), (not illustrated).

The coil tubing installation 70 and the support structure 3 together with said access module 1 constitute the support and the guiding 60 for the compensation frame 3 and the support structure 1, and comprises the compensators, there being arranged two passive compensators mounted in between said supporting structures 1 and 3, making a total of 4 compensators 70A–70D, in addition to 2 active compensators between said support structures 1 and 3, namely 80A and 80B.

Required air bottles, hydraulic units, compressors for the compensators and control system will be installed on the access module. The hydraulic unit for power supply will be installed in a dedicated container and connected to the rig by hydraulic hoses.

DETAILED DESCRIPTION

In the following there will be given a further description of the different modules which are included in an embodiment of the invention.

Figure 1B:
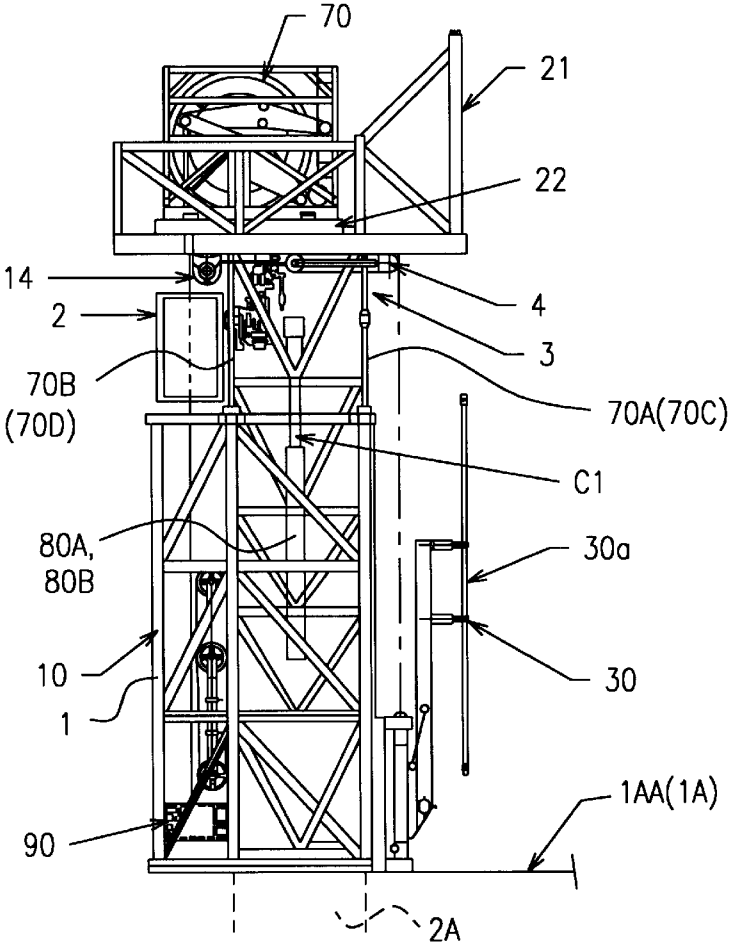
FIGS. 1A and 1B illustrate a front view and a side view, respectively, of a coil tubing installation and the associated support structure.
Figure 1A:
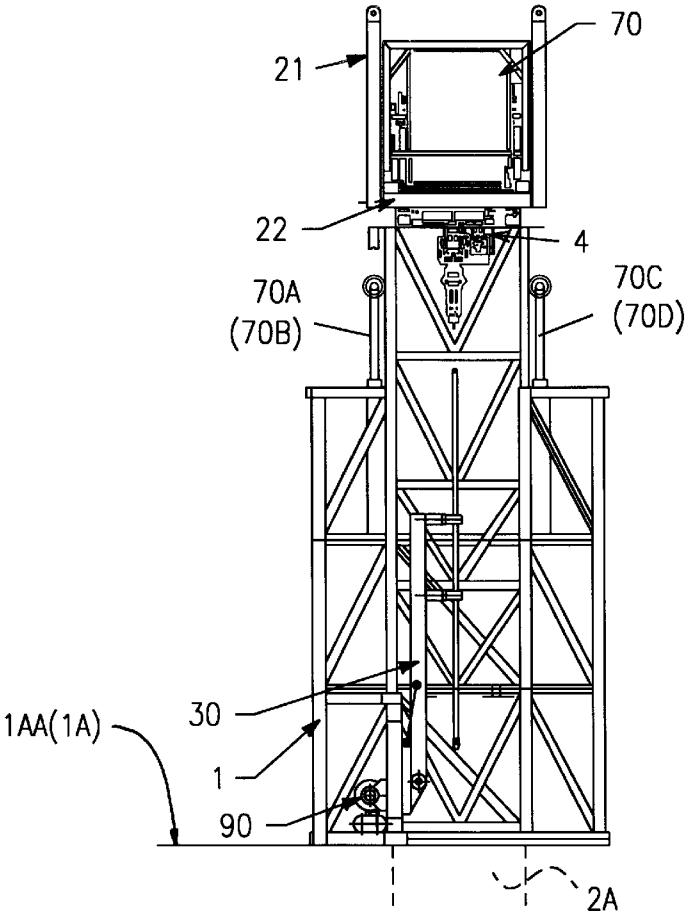

In FIGS. 1A and 1B it appears that the illustrated embodiment for a coil tubing installation and support structure, here also designated as a second frame-like structure 1, comprises a truss which can be approximately 17 meters high. This structure 1 forms the one side of the pipe and riser support arrangement. The structure 1 has on the one side a hoisting machinery 90, which can be used for bringing the different operational modules up to the compensation and support structure, here also designated as a first frame-like structure 3. In addition there may on the frame or structure 3 be installed a hoisting machinery 85, see FIGS. 4A and 4B. The frame 3 is designed as an open structure in order to be able to bring the different modules required for the different operations, in between the hoisting hooks. It is to be understood that the structure 3 is heave compensated in relation to the vessel 1A.

The hoisting machinery 90 comprises two hoisting drums, one on each side of the structure 3, as well as a mast extension on each side of the structure 3, comprising sheaves and a hoisting block on each side of the frame. The hoisting machinery is motion compensated on a system which is capable of compensating the relative movement between the vessel 1A and the compensated support structure 3, and the hooks are run in guides in order to maintain control of the different modules as they are lifted, see also FIG. 3.

An emergency access to the top of the compensation and support structure 3 from the support structure 1 is installed between said modules or frames 1 and 3.

Between said frames 1 and 3 there are installed a total of two compensators 80A and 80B, said compensators being connected to the compensation and support structure 3 when this is installed.

Figure 5:
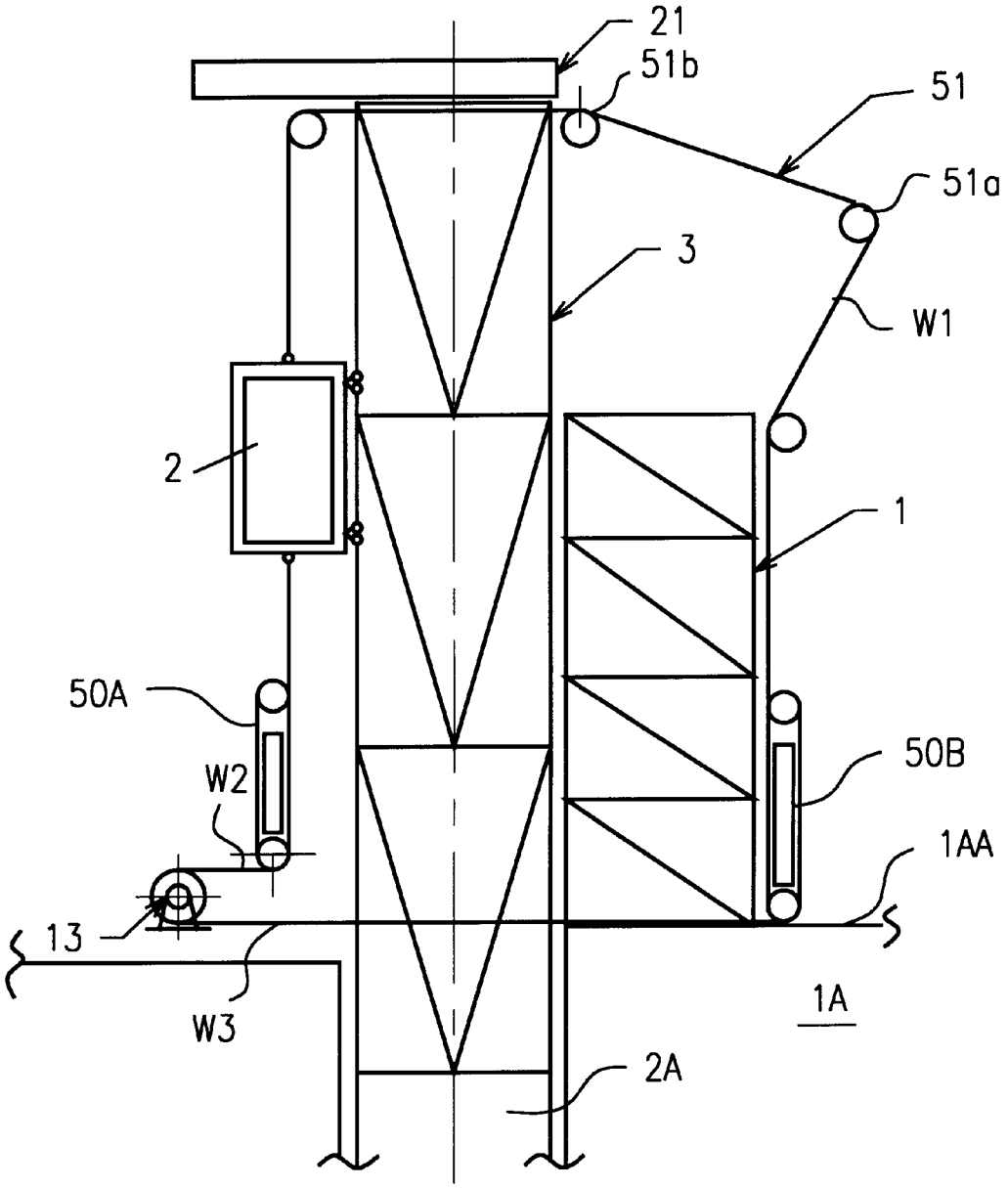
FIG. 5 is a schematic sketch illustrating the operation of elements included in a preferred compensation system for a hoisting machinery for a personal lift.

Within the supporting frame 3 there is found a personal lift 2 which provides access to the compensation and supporting structure 3, said personal hoist being operated by a hoisting machinery, namely a hoisting machinery 13, see FIG. 5, at the deck 1AA on the vessel 1A. The hoist is driven by a double hoisting machinery arranged on deck or on the access module 10 where one wire runs from the top of the hoist drum and one runs from below the hoisting drum, such that when the drum is in operation there will be given out rust as much from the one drum as is taken in by the second.

Each of the wires W2 and W3 from the hoisting machinery 13 is guided around a compensator 50A and 50B. One of the wires W2 is connected with the bottom side of the personal lift 2, whereas the other wire W3 continues over a rocker arm 51 and over a sheave arrangement, and is attached to the top of the personal lift 2.

This arrangement allows the personal lift 2 to be run in parallel with the top compensated support structure 3, or alternatively, in parallel with the deck 1AA of the vessel. This is achieved by letting one or the other of the compensators 50*a* or 50*b* be operable depending on which direction or relative movement to be compensated.

In the supporting frame 1 there are, as mentioned earlier, a total of two compensators 80A and 80B, which are connected to the compensation and support structure 3 when this is installed. In addition to the above, the accumulator banks, the compensator control and the compressor and hydraulic unit required for the compensator system, will be installed separately on the deck 1AA.

In FIGS. 1A and 1B there is also illustrated the top of the compensation and support structure 3 on which there is installed a compensation and support unit 21, said unit 21 being connected to the compensator system installed between the support structure 1 and the frame 3.

Figure 2B:
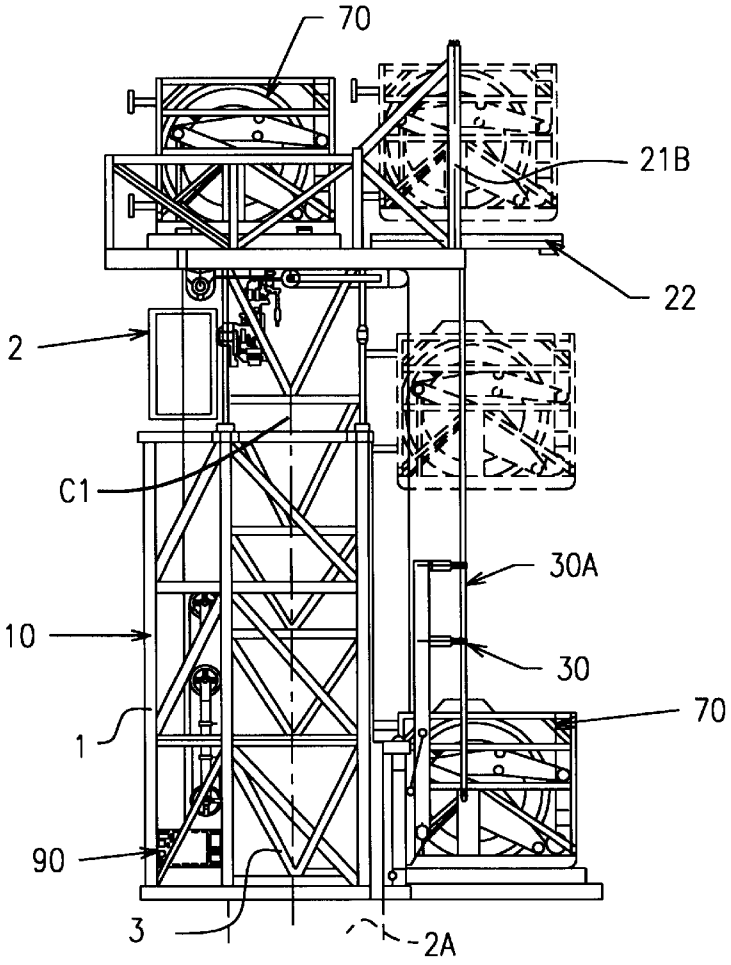
FIGS. 2A and 2B illustrate views similar to FIGS. 1A and 1B, respectively, but include different steps of operation for handling coil tubing reels.
Figure 2A:
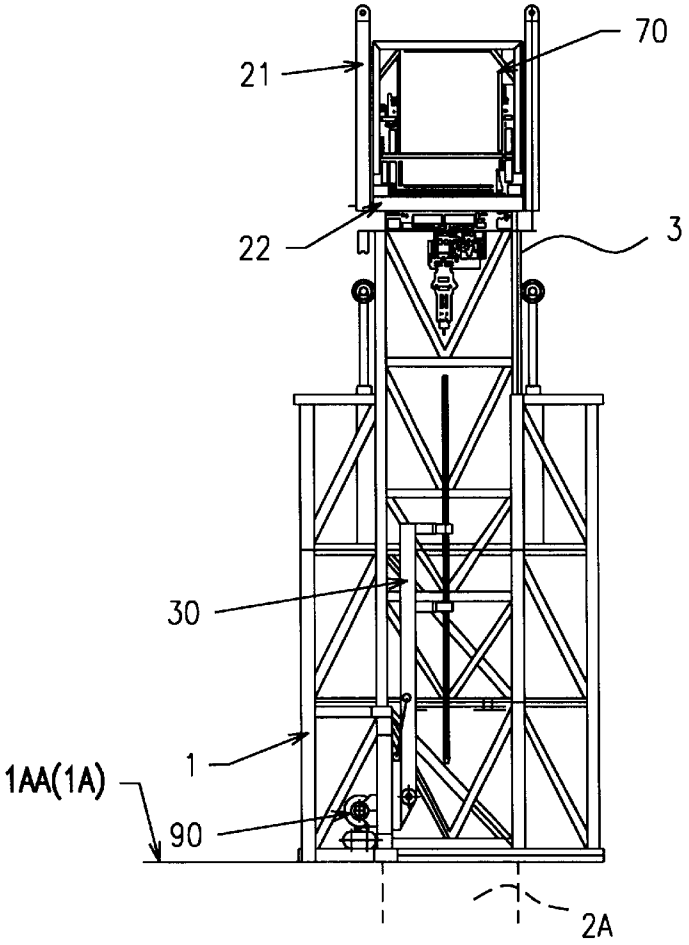

On the unit 21 there is installed a trolley 22 which can carry a coiling tube reel 70, and which can move beyond the coil tubing support structure 1, and in this end position see also FIGS. 2A and 2B, it can be used for transporting equipment from this location, the equipment being lifted by the hoisting machinery 90 and brought in over the centre area C1 of the moon pool opening 2A.

Figure 4A:
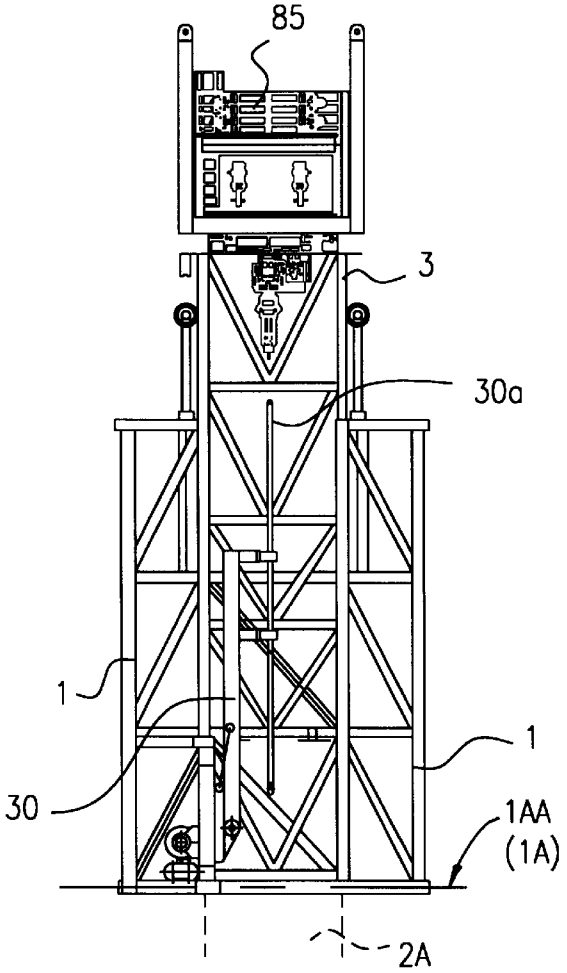

In FIGS. 1A and 1B as well as in FIGS. 4A and 4B there is also illustrated a pipe handler 30, which handler is designed to operate in the following two modes:

1. Handling of pipe 30*a* when the compensation and support structure 3 is stationary.
2. Handling of pipe 30*a* when the compensation and support structure 3 is compensated, which is required when drilling with drilling pipes is effected, liners are installed, and upon completion of wells after the sea bed blow-out preventor CAT BOP is installed.

In order to achieve said functions the pipe handler 30 must be able to operate in the following two modes:

Operate with no relative motion between pipe handler 30 and the deck 1AA of the vessel.

Operate with no relative movement between the pipe handler 30 and the compensated support structure 3.

Figure 6:
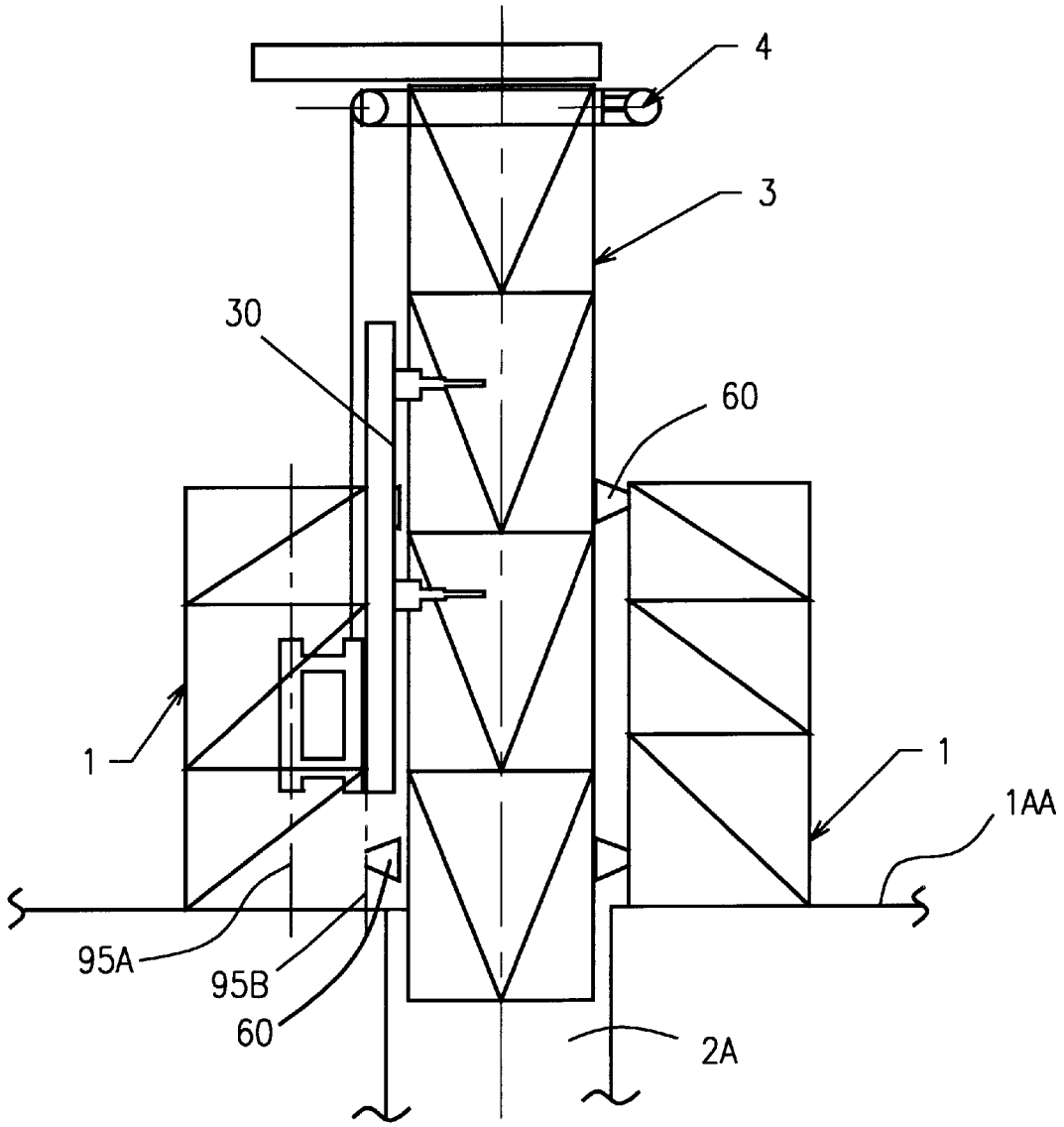
FIG. 6 is a schematic sketch for illustrating the principle of compensating a pipe handling device.

To achieve this the pipe handler 30 is installed on a rail system 95A and 95B, see FIG. 6, which allows that the compensated support structure 3 can move relative to the pipe handler 30, at the same time as the pipe handler 30 is driven by a hydraulically operated jigger winch where the wire out of the winch is compensated.

This will allow the pipe handler 30 to remain supported at the deck 1AA of the vessel 1A as long as the pipe handler 30 picks up a pipe 30*a* from the deck, and when the pipe is lifted up to vertical position ready to be moved into the compensated supporting frame 3, the pipe handler 30 will be lifted by a stroke change of the jigger winch, and will thereafter move synchronously with the compensated support frame 3.

The pipe handler 30 will now follow the compensated support frame 3 without any relative movement between said frame 3 and said pipe handler 30.

According to FIG. 5 which illustrates the specific form for compensation for the hoisting machinery 13, namely in that the compensating system for the hoisting machinery comprises two compensator units 50*a*, 50*b*, wherein a first one 50*a* is connected to the bottom side of the lift 2 and the other at the upper side of the lift 2, one will be able to select the side against which one should compensate.

Specifically, such an embodiment could be so designed that the compensating system is mounted on a rocker arm 51 the one side 51*a* thereof being connected to the "stationary" outer frame 1, and the other side 51*b* thereof being connected to the "compensating" frame 3, and wherein the wire W1 from the one compensator is guided over the arm 51, such that the movement of the compensated part will not influence the wire.

Further, it may be appropriate that the movement of the hoist 2 up and down is provided by a winch 13, wherein the one wire part W2 is arranged at the top of the winch drum and the other W3 at the bottom side of the winch drum, such that during operation there will be reeled off just as much wire on the one winch half as is reeled in on the other.

It should also be referred to FIG. 6 from which it is to be understood that an appropriate adaption of the pipe handling device can involve that the pipe handling device 30 is lifted by a jigger winch, (possibly a normal winch), wherein the winch operates as constant tension winch when the pipe handler 30 rests on the deck 1AA, and as a lifting device when the pipe handler 30 is lifted up into position in order to feed pipes into the compensated frame 3.

The pipe handler 30 will then, when it is lifted, follow the movement of the compensated frame 3, and thereby be able to grip a pipe in the compensated frame 3 and pass the pipe out therefrom and down on the deck 1AA by lowering the "hoisting machinery"/compensators until the pipe handler 30 rests on deck.

In the following, under reference to FIGS. 7 to 10 there will be given a further description of how the different units will function.

Figure 7:
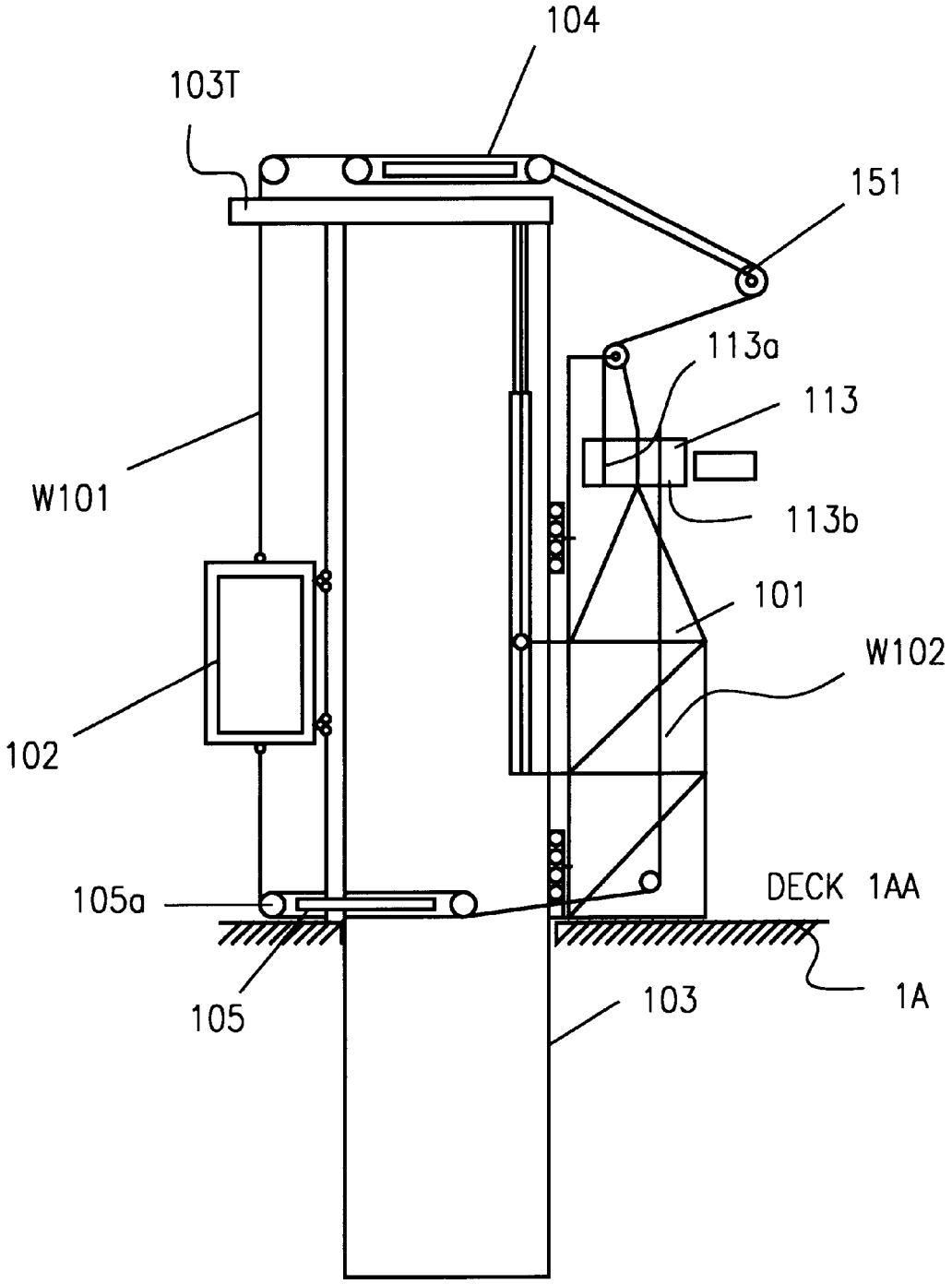
FIG. 7 is schematical view illustrating a further arrangement for compensating a lift.
Figure 8:
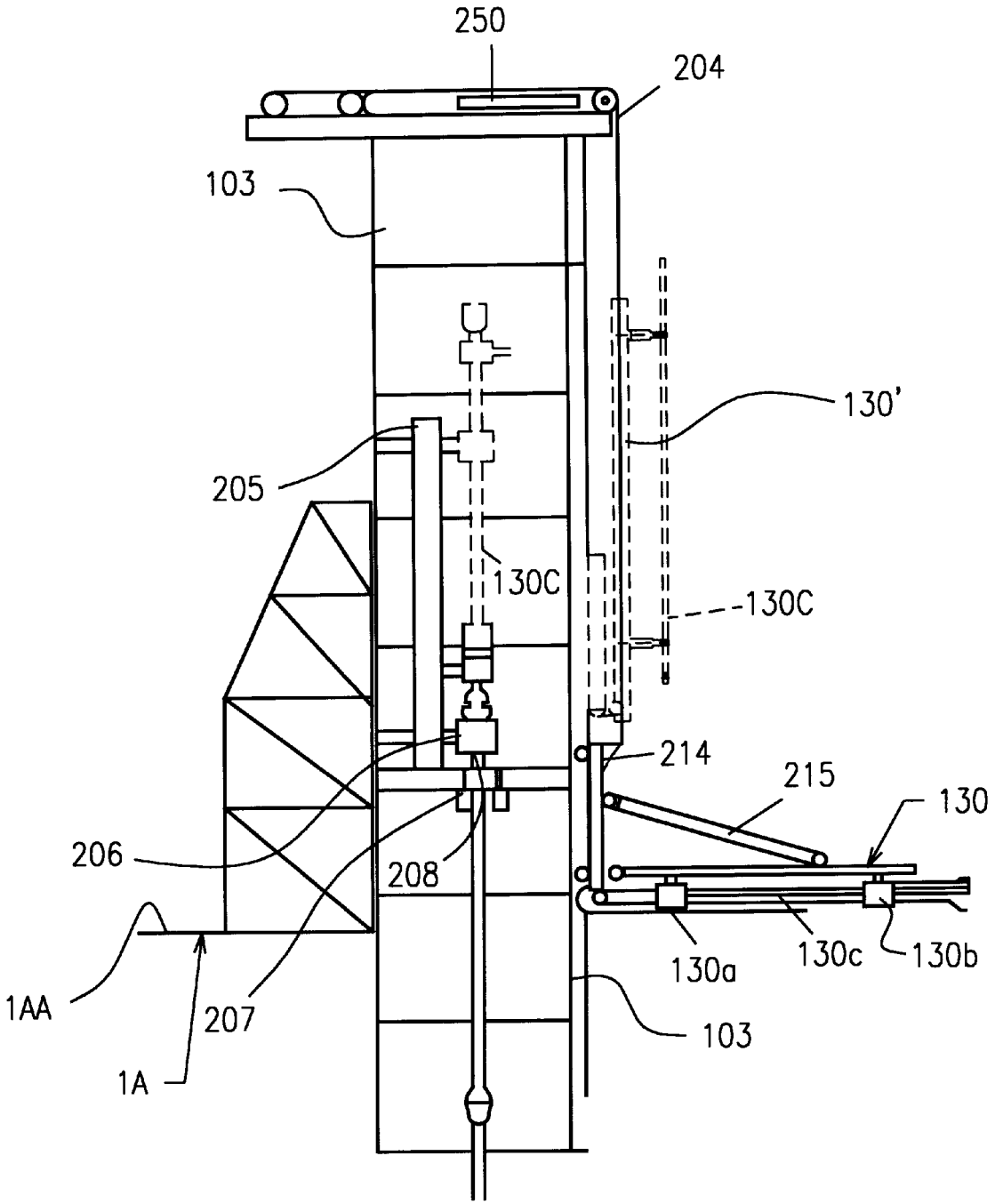
FIG. 8 is a schematical view illustrating another embodiment related to pipe handling.

Compensated lift, FIG. 7

The schematic sketch of FIG. 7 illustrated the lift 102 on its way up in the compensated tower or frame 103. The system operates as follows:

The lift 102 is at the top connected to a first wire W101 which runs over a top sheave at the top of the compensated frame 103, over a passive compensator 104 at the top of the compensated frame 103 for holding said wire W101 tense, further down along a rocker arm 151 and down onto a winch 113 having a split drum 113*a*, 113*b*, said wire W101 being attached to one of the drum halves 113*a*. Wire number two W102 runs from the second drum half 113*b*, i.e. the other side of the drum, and down over a passive compensator 105 and via wire sheave 105*a* to be attached to the bottom side of said lift 102.

When the lift 102 is at the bottom and is to be lifted, then the compensator 105 is locked and the compensator 104 is active. When the wire W101 is started then the lift 102 will be lifted with a constant velocity relative to the supporting frame 101 which is located on the deck 1AA on the vessel 1A. When the lift 102 has been lifted a certain height the lower compensator 105 will be activated, whereas the upper compensator 104 is forced into its middle position.

By so doing the lower compensator 105 will be activated and the upper compensator 104 will be locked. The lift 102 thereafter moves with a constant velocity relative to the compensated frame 103 and upon stopping at the top the change in height between the deck 1AA of the vessel 1A and the top 103T of the compensated frame 103 will be compensated by letting the lower compensator 105 take in and give out wire, i.e. holding the wire W101 and W102 tight with a certain force.

When the lift 102 is to be lowered then the described procedure will be reversed.

Figure 10:
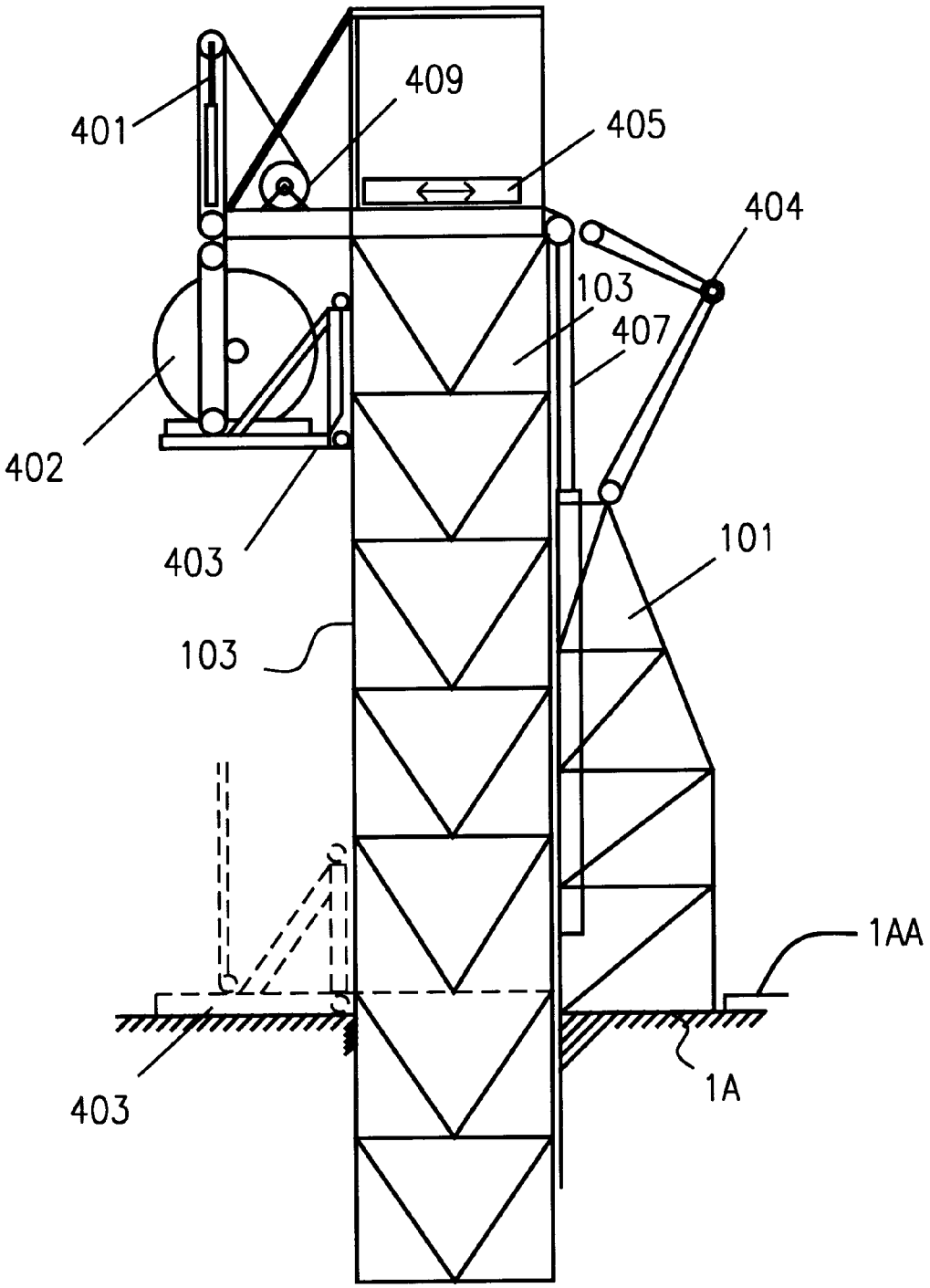
FIG. 10 is a schematical view illustrating handling of coil tubing reel.

Pipe handler, FIG. 10

Pipe handling in and out of the compensated frame 103 will be affected by means of a pipe handler 130 provided with grippers 130*a*, 130*b*, said pipe handler 130 being mounted in a trolley 214 including a cylinder 215 which allows for the pipe handler 130 to be lifted from horisontal to vertical position 130'.

At the top the trolley 214 is connected to a wire 204 which is guided over a jigger winch 250. The lifting height of said jigger winch 250 is adapted such that the pipe always will be lifted to the same height on the compensated frame 103. The pipe handler 130 is mounted on a swinging machinery in the trolley 214, which allows that it can be swung into the compensated tower of frame 103 so as to present the pipe 130*a* above the centre of rotation.

In the compensated frame 103 there is mounted a machine 205 which receives the pipe 130*c* from the pipe handler 130, such that the pipe handler shall not spend time on the operation to be performed in the tower. The machine 205 in the tower grips the pipe 130*c* from the pipe handler 130, brings it into position in relation to the pipe already hanging in a slip 207 in the turning table 208, which in turn is supported by the guide 206 for the lower pipe, such that the latter pipe is in line with the pipe to be screwed together. The connecting machine 205 lowers the pipe onto the pipe hanging in the spinning table, spins the pipe in threads and tightens the connection with a certain moment.

When the pipe is handled in or out of the compensated frame 103 the following steps are taken:

The pipe handler 130 is in a horizontal position with the jigger winch 250 in its tension mode, and said grippers 130*a* and 130*b* are telescoped out for gripping the pipe 130*c*.

The pipe handler 130 is swung to its vertical position and is lifted away by the jigger winch 250 to its full lifting height. In this position the pipe handler 130 is swung into the tower 103, the telescopes on the grippers 130*a* and 130*b* are driven out and the pipe is transferred to the grippers of the connecting machine 205.

The pipe handler 130 thereafter releases the pipe 130*c*, the telescopes are retrieved, the pipe handler 130 is swung out of the tower 103 and is lowered until it is supported by the deck 1AA of the vessel 1A.

Upon reaching the deck the jigger winch 250 will enter its constant tension mode and the pipe handler 130 will be rotated to its horisontal position ready for picking up the next pipe.

Figure 9:
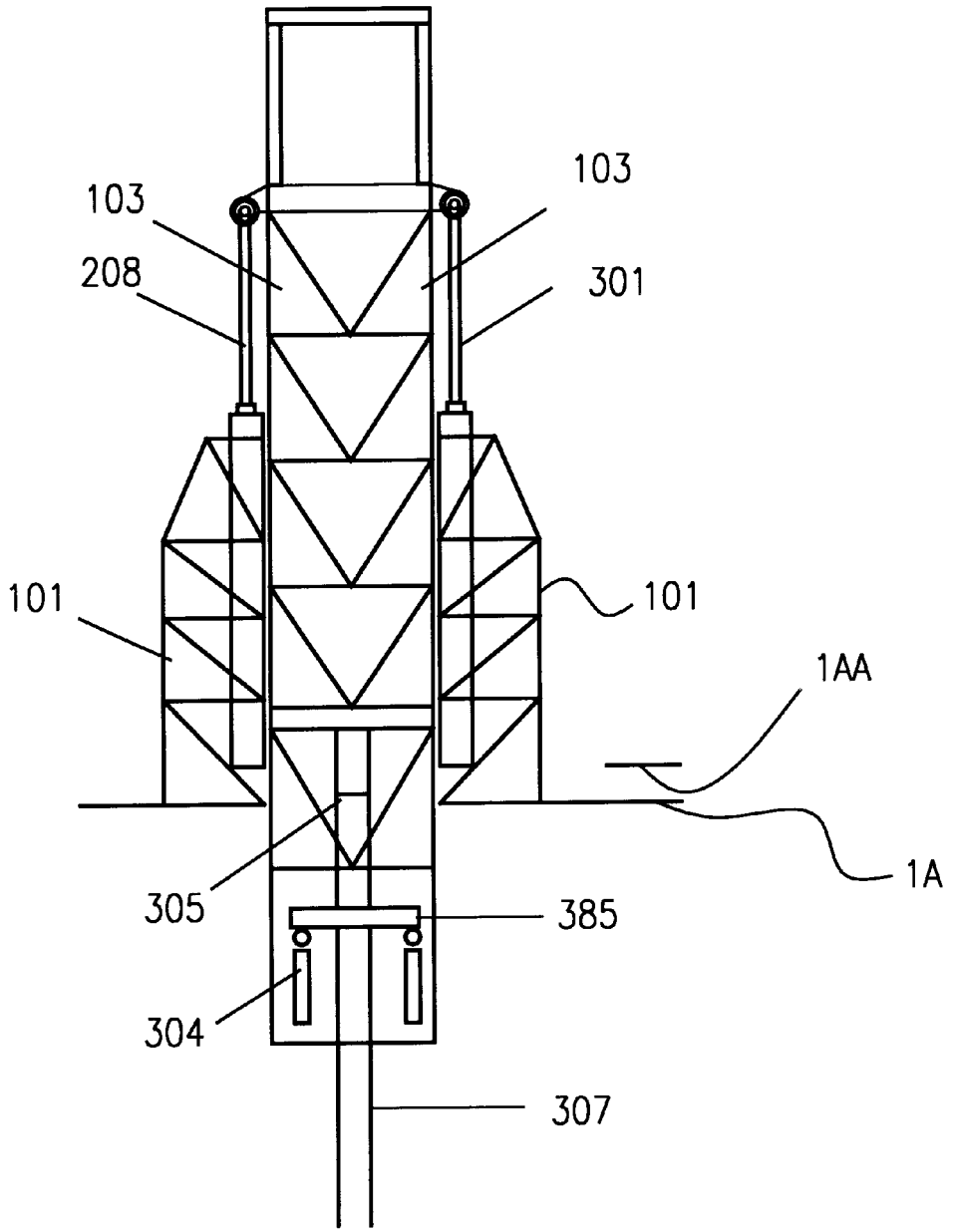
FIG. 9 is a schematical view illustrating an embodiment for a compensator system of a compensated frame in relation to the vessel deck, including tidal adjustment means.

Compensator system, FIG. 9

The compensation of the compensated frame 103 in relation the deck 1AA of the vessel 1A, is done by means of two independent systems, the first system 301 is passive and is operated by having a connection via a riser 307 or similar, to the sea bed, said riser being connected to the compensated frame 103 which is guided in two side frames 101. By having a pressure in the passive compensating system this will carry the weight of the frame 101, all equipment which is mounted in said frame, give a tension in the riser, as well as carry a part of the weight hanging in said frame.

The passive system 301 comprises one or more cylinders which are mounted on each side of the compensated frame 101.

In addition to the passive system 301 there is mounted an active system 208 which can compensate the compensated frame 103 when this is not connected to a riser or the sea bed. This system is also used for taking some of the change of weight which is provided by adding or removing pipe sections from the drilling string. By running the active system this will absorb this change of weight, such that a constant tension in the riser 307 can be maintained, and one avoids the correction of the pressure in the passive system during the overall operation.

This is done in the following manner:

The passive compensating system 301 is given a pressure equal to the pre-determind pressure including a working margin. The active cylinders are driven in tension, such that the net power on the compensated platform 103 will equal the required power.

By building up a drilling string the weight on the compensated platform will increase, such that the power which is at disposal will decrease.

In order to counteract this the active cylinders 208 are driven under control of the movement of the platform, i.e. is controlled on quantity, and not on pressure, such that even if said sylinders are tuned to give a maximum pulling power the pressure in the cylinders will be reduced in pace with the loading on the platform, until they only follow the movement of the platform without pulling the system, i.e. are passively entrained. In this situation the platform is passively compensated and the active sylinders have no more any function.

If it is desired to further load the platform than the pressure will be increased in the passive compensating cylinders 301, which automatically will let the passive system be reactivated.

The active system comprises one or more cylinders 208 mounted on each side of the compensated frame 103.

In order to avoid that the difference in tide water should consume or disturb the compensating capacity, it is suggested to let the riser 307 be suspended in its own frame 385 which is running in guides in the compensating frame 103, and which are suspended in cylinders 304. This frame 385 will be adjusted as the tide water changes, such that the compensated frame 103 always will be operated from a central position.

In addition, this system can be used to increase the total compensating capacity in case the vessel should drift off.

The carrying frame for the riser is connected to the drilling deck with a telescopic pipe connection 305 in order to allow return of drilling mud.

Handling of coil tubing reel, FIG. 10

In order to handle coil tubing from the deck 1AA of the vessel 1A and to the top of the compensated frame 101 there is mounted a hoisting machinery 409 at the top of the compensated frame 101. The wire W401 from the hoisting machinery 409 is guided from said machinery via a passive compensator 401 and down to a lifting platform 403.

When the platform 403' stands on the deck of the vessel the compensator 401 is in its passive mode, i.e. operating at constant tension, for holding said wire tense.

The coil tubing reel 402 is skided in on the lifting platform by means of a skid system at the deck on the vessel, and is thereafter secured to said platform.

During this operation the compensator 401 is operating as a constant tension system for holding said hoisting wire tense.

When the reel 402 is to be lifted off this will be done by driving the compensator 401 to its maximum stroke at the same time as the hoisting machinery 409 is started at full speed. This will involve the lifting of the lifting platform 403 and the reel approximately 1½ meters in a short span of time, for thereby avoiding that the platform meets the deck 1AA as the deck may be lifted due to wave motions, and then quicker than the load being lifted by the lift.

When the lifting platform 403 is lifted off the deck 1AA it will continue upwardly along the compensated frame 103 by means of the hoisting machinery 409 until it reached the top of the frame.

When reaching the lop of said frame 103 the coil tubing support trolley 405 is driven underneath the reel, the reel is transferred to said trolley by being lowered thereupon by means of the hoisting machinery. When the reel is resting on the trolley the latter will be driven into the centre of the compensated frame 103 at which position the trolley will be parked and secured.

On the trolley 405 there is mounted a system allowing for the reel 402 to be driven sidewise, such that the pipe when being coiled off the reel, all the time will be centered in the compensated frame 103, for thereby avoiding further and superfluous bendings on the coil tubing, which is very important as regards the life-time of the pipe.

I claim:

1. An arrangement in connection with the drilling of oil wells with coil tubing, and more specifically an arrangement comprising heave compensation by such drilling, comprising a first frame-like structure (3) which is mounted on a floating vessel (1A) for allowing movement at least in the vertical direction in relation to said vessel, as well as devices for providing compensating power between said first frame structure (3) and said vessel (1A), further comprises a second frame-like structure (1) associated with said first frame-like structure arranged stationary on a deck (1AA) of the vessel (1A), said first frame-like structure (3) and said second frame-like structure (1) being assembled by means of a compensating system (4) allowing compensation of said relative movement between the vessel (1A) and said first frame-like structure (3) including heave compensation both in relation to said vessel (1A) and said first frame structure (3).

2. The arrangement as claimed in claim 1, characterized in that the first frame-like structure (3) is provided as an inner frame structure (21) in relation to the second frame-like structure (1) and comprises a platform (21) on the top thereof where a coil tubing reel (70) can be positioned and operated.

3. The arrangement as claimed in claim 2, characterized in that the arrangement comprises a trolley (22) which is included in the first frame-like structure (3, 21), said trolley (22) being used as a carrier for a coil tubing reel (70).

4. The arrangement as claimed in claim 3 wherein the trolley (22) is located at the top of said first frame-like structure (3).

5. The arrangement as claimed in claim 3, characterized in that the trolley (22) is provided with controlled driving means for displacing said trolley (22) such that a pipe depending from the coil tubing reel will be above a drilling center (C1) of a drilling hole (2A).

6. The arrangement as claimed in claim 2, characterized in that between said two frame-like structures (1, 3) there is provided said compensating system comprising a compensated hoisting machinery (90) allowing for transport of the coil tubing reel (70) or other equipment from the deck (1AA) on the vessel (1A) and to the top of the first frame-like structure (3), preferably to the inner frame structure (21) when this is compensated.

7. The arrangement as claimed in claim 6, characterized in that the compensating system for the hoisting machinery (4) comprises a lift and two compensator units, one of which being connected to the bottom side of said lift and the second at the upper side of said lift, such that the side against which to be compensated against, can be selected.

8. The arrangement as claimed in claim 7, characterized in that in the compensating system there is mounted a rocker arm (51) wherein one side is connected with the first frame-like structure (3) and the second side is connected to the second frame-like structure (1), and wherein a wire of one of the compensators are guided above the arm (51) such that the movement of the first frame-like structure is not influencing the wire.

9. The arrangement as claimed in claim 8, characterized in that movement of the lift up and down is driven by a winch (13) wherein one part of the wire (W2) is placed on the top of a winch drum and a second part of the wire (W3) is arranged on the bottom side of the winch drum, the top of the winch drum and the bottom of the winch drum each defining one winch half, such that by operation the winch will give out just as much wire on the one winch half as is taken in on the other winch half.

10. The arrangement as claimed in claim 1, characterized in that the arrangement comprises a personnel lift (2) comprising one or more compensators for compensated communication between said second frame-like structure (1) and said first frame-like structure (3).

11. The arrangement as claimed in claim 1 further comprising a pipe handling means (30).

12. The arrangement as claimed in claim 11, characterized in that the pipe handling means (30) is connected to a winch, said winch being operated as a constant tension winch when said pipe handling means (30) rests on deck, and which winch operates a lifting device when the pipe handler (30) is lifted up to a position for feeding pipes into the first frame-like structure (1, 101).

13. The arrangement as claimed in claim 1 further comprising a modified snubbing unit for drilling with drilling pipes.

14. The arrangement as claimed in claim 13 further comprising hydraulic hoisting means for pipe handling.

15. The arrangement as claimed in claim 1 further comprising a spinning table installed around the first frame-like structure.

16. The arrangement as claimed in claim 1, characterized in that the arrangement further comprises a riser support frame (385) for compensating tide water changes.

17. The arrangement as claimed in claim 16 wherein said first frame-like structure further comprises guiding means and said riser support frame (385) is arranged in said guiding means of said first frame-like structure (103), said riser supporting frame (385) being suspended by cylinders (304).

18. The arrangement as claimed in claim 16 characterized in that said riser support frame (385) comprises adjusting means for adjusting said frame in accordance with tide water changes, such that said first frame-like structure (103) always operates from a central position, said riser support frame (385) further including means for increasing the total compensating capacity in case of vessel drift off.

* * * * *